US006049264A

United States Patent [19]

Sailer et al.

[11] Patent Number: 6,049,264

[45] Date of Patent: Apr. 11, 2000

[54] ELECTROMAGNETIC ACTUATOR WITH COMPOSITE CORE ASSEMBLY

[75] Inventors: Hans J. Sailer, Williamsburg, Va.; James A. Nitkiewicz, Regensburg, Germany

[73] Assignee: Siemens Automotive Corporation, Auburn Hills, Mich.

[21] Appl. No.: 09/181,206

[22] Filed: Oct. 28, 1998

Related U.S. Application Data

[60] Provisional application No. 60/069,144, Dec. 9, 1997.

[51] Int. Cl.[7] ..... H01F 7/08

[52] U.S. Cl. ..... 335/220; 336/234

[58] Field of Search ..... 335/262, 220, 335/263–6, 228, 229; 251/129.01; 336/210, 212, 234

[56] References Cited

U.S. PATENT DOCUMENTS

| | | | |
|---|---|---|---|
| 3,577,107 | 5/1971 | Ditzingen et al. | 335/248 |
| 3,577,109 | 5/1971 | Foster et al. | 336/212 |
| 4,009,460 | 2/1977 | Fukui et al. | 336/110 |
| 4,818,966 | 4/1989 | Miyamoto et al. | 335/296 |
| 5,371,486 | 12/1994 | Yamada et al. | 336/212 |
| 5,636,601 | 6/1997 | Moriya et al. | 256/129.01 |
| 5,703,559 | 12/1997 | Emmerich et al. | 336/234 |

FOREIGN PATENT DOCUMENTS

| | | |
|---|---|---|
| 1592884 | 6/1970 | France . |
| 2223116 | 11/1973 | Germany . |
| 2324644 | 12/1974 | Germany . |

*Primary Examiner*—Lincoln Donovan

[57] ABSTRACT

A core assembly for an electromagnet includes a plurality of stacked laminations extending along a stacking axis. The laminations each having generally the same thickness in a direction along the stacking axis. A solid core member has opposing ends. The core member is disposed generally centrally with respect to the plurality of stacked laminations such that each end of the core member contacts a lamination of the plurality of laminations. The core member has a thickness in a direction along the stacking axis substantially greater than the thickness of a lamination. The core member also has an aperture therethrough disposed generally perpendicular to the stacking axis for receiving a shaft of an armature assembly.

5 Claims, 1 Drawing Sheet

ELECTROMAGNETIC ACTUATOR WITH COMPOSITE CORE ASSEMBLY

This Patent Application claims priority to copending U.S. Provisional Patent Application No. 60/069,144, filed Dec. 9, 1997, the contents of which is hereby incorporated by reference in its entirety herein.

FIELD OF THE INVENTION

This invention relates to an electromagnetic actuator for a vehicle engine and, more particularly, to a core assembly of a solenoid-type actuator having a plurality of stacked laminations and a moving armature.

BACKGROUND OF THE INVENTION

A conventional electromagnetic actuator for opening and closing a valve of an internal combustion engine generally includes "open" and "close" electromagnets which, when energized, produce an electromagnetic force on an armature. The armature is biased by a pair of identical springs arranged in parallel. The armature is coupled with a gas exchange valve of the engine. The armature rests approximately half way between the open and close electromagnets when the springs are in equilibrium. When the armature is held by a magnetic force in either the closed or opened position (at rest against the open or close electromagnet), potential energy is stored by the springs. If the magnetic force is shut off with the armature in the opened position, the spring's potential energy will be converted to kinetic energy of the moving mass and cause the armature to move towards the close electromagnet. If friction is sufficiently low, the armature can then be caught in the closed position by applying current to the close electromagnet.

Generally, each electromagnet of a conventional electromagnetic actuator comprises a plurality of stacked laminations joined to define the core of the actuator. This core design offers the advantage of high efficiency by minimizing eddy current loses in the magnetic material. However, a disadvantage of this design is that machining of the laminations must be performed in a plane perpendicular to the orientation of the laminations which tends to cause the laminations to spread apart. This may result in poor dimensional control and burr formation. Furthermore, an aperture is generally provided through the core to receive a press-fit bushing to support a reciprocating shaft of the actuator. The stacked lamination core design cannot support the press-fit bushing due to the spreading of the individual laminations.

Accordingly, there is a need to provide an electromagnetic actuator having a core assembly which minimizes eddy currents yet is capable of receiving a bushing to support a reciprocating shaft.

SUMMARY OF THE INVENTION

An object of the present invention is to fulfill the need referred to above. In accordance with the principles of the present invention, this objective is obtained by providing a core assembly for an electromagnet including a plurality of stacked laminations extending along a stacking axis, the laminations each having generally the same thickness in a direction along the stacking axis. A solid core member is provided and has opposing ends. The core member is disposed generally centrally with respect to the plurality of stacked laminations such that each end of the core member contacts a lamination of the plurality of laminations. The core member has a thickness in a direction along the stacking axis substantially greater than the thickness of a lamination. The core member also has an aperture therethrough disposed generally perpendicular to the stacking axis for receiving a shaft of an armature assembly.

In accordance with another aspect of the invention, an electromagnetic actuator for mounting to a cylinder head of an engine is provided. The actuator includes first and second electromagnets disposed in spaced relation. Each electromagnet includes a core assembly and a coil associated with the core assembly. Each core assembly includes a plurality of stacked laminations extending along a stacking axis. The laminations each have generally the same thickness in a direction along the stacking axis. Each core assembly also includes a solid core member having opposing ends. The core member is disposed generally centrally with respect to the plurality of stacked laminations such that each end of the core member contacts a lamination of the plurality of laminations. The core member has a thickness in a direction along the stacking axis substantially greater than the thickness of a lamination. The core member has an aperture therethrough disposed generally perpendicular to the stacking axis. A bushing is disposed in the aperture. The actuator also includes an armature mounted for reciprocal movement between the electromagnets and a shaft coupled to the armature and supported for reciprocal movement via the bushings.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
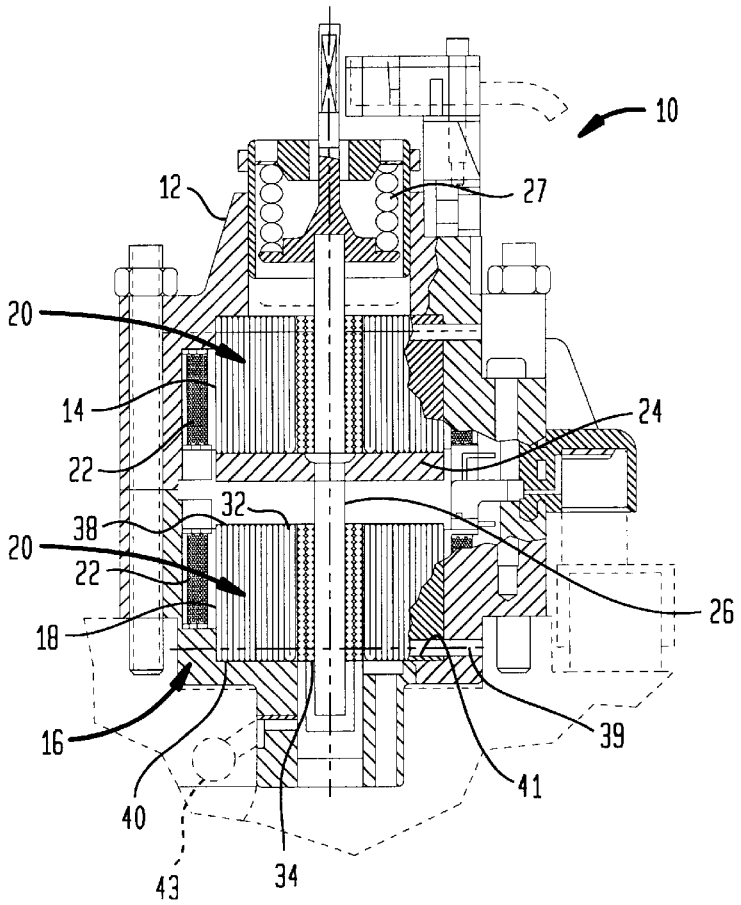
FIG. 1 is a sectional view of an electromagnetic actuator having electromagnet core assemblies provided in accordance with the principles of the present invention.

Referring to FIG. 1, an electromagnetic actuator is shown, generally indicated 10, having electromagnet core assemblies provided in accordance with the principles of the present invention. The electromagnetic actuator 10 includes an upper housing assembly, generally indicated at 12, containing an upper electromagnet 14, and a lower housing assembly, generally indicated at 16, containing a lower electromagnet 18. Each electromagnet 14 and 18 includes a core assembly, generally indicated at 20, and a coil assembly 22. A generally rectangular armature 26 is arranged for movement between the electromagnets 14 and 18. The armature 24 is carried by a reciprocating shaft 26 The shaft 24 is configured to be coupled to a stem of a gas exchange valve (not shown) of an engine of a vehicle in the conventional manner. In the conventional manner, a pair of opposing springs are associated with the armature 24. One spring 27 is shown in FIG. 1. The other spring (not shown) is disposed near the cylinder valve.

Figure 2:
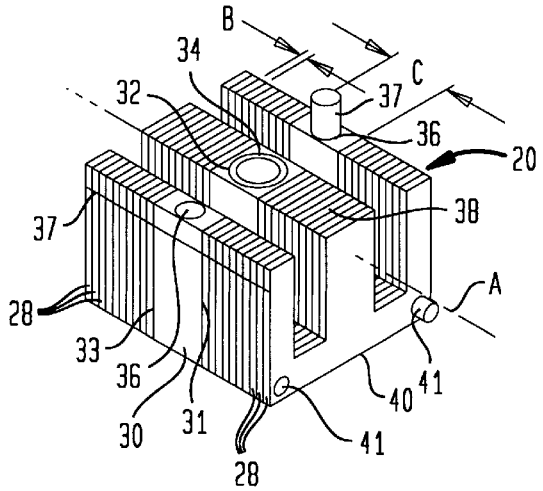
FIG. 2 is a perspective view of a core assembly of a lower electromagnet of the electromagnetic actuator of FIG. 1, provided in accordance with the principles of a first embodiment of the present invention.

The invention will be described with regard to the lower electromagnet 18. It will be appreciated, however, that the principles of the invention are applicable to the structure of the upper electromagnet 14 as well. Thus, with reference to FIG. 2, the core assembly 20 is shown provided in accordance with the principles of the present invention. The core assembly 20 comprises a plurality of laminations 28 stacked with respect to a stacking axis A. The laminations generally have the same thickness B in a direction along the stacking axis A and are preferably composed 29 gage M15 C5 soft magnetic material. Other suitable materials of various gages may be employed for the lamination. Two laminations of the plurality laminations 28 contact opposing ends 31 and 33 of a solid center core member 30 such that the core member 30 is disposed generally centrally between the plurality of laminations 28. Each lamination 28 is generally E-shaped defining channels 32 to receive the associated coil assembly 22 (FIG. 1).

In accordance with the invention, the solid center core member 30 has ends 31 and 33, a top surface 38 and a bottom surface 40. A thickness C of the core member 30 as defined between ends 31 and 33 or in a direction along the stacking axis, is substantially greater than a thickness B of the individual laminations 28. The center core member 30 is also of E-shape, is composed of silicon iron, and has a thickness C of about 8–12 mm. In the illustrated embodiment, the center core member 30 is composed of 2.5% silicon iron and has a thickness of about 10 mm. The core member 30 also includes a center aperture 32 therethrough extending from the top surface 38 to the bottom surface 40. The aperture 32 receives a bushing 34, press-fitted therein. Thus, the aperture 32 is disposed generally perpendicular to the stacking axis A. The bushing 34 supports the reciprocating shaft 26 (FIG. 1). The core member 30 may also include one or more apertures 36 for receiving a support pin 37. The support pin(s) are received in apertures in the armature 23 to provide additional support of the reciprocating armature 24 and thus prevent twisting thereof.

The laminations 28 and core member may be secured together by a weld 37 on each side thereof. It can be appreciated that the laminations 28 may be joined in any other conventional manner, such as, for example, an interlocking or mechanical upset arrangement, gluing, riveting or a combination of these techniques. After assembly, surfaces 38 and 40 of the core assembly are machined so as to be substantially parallel.

Pins 39 are disposed through apertures 41 in the core assembly 20 to secure the core assembly 20 to the housing assembly 16.

It can be appreciated that with the composite structure of the core assembly of the invention, the stacked laminations 28 provide a high efficiency core by minimizing eddy current losses, while the solid core member allows for easy machining of surfaces 38 and 40 and provides good support of the press-fit bearing 34 disposed in the aperture 32 of the core member 30. The solid core member 30 may include oil passages therein to lubricate the bearing 34 via oil galley 43.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A core assembly for an electromagnet, the core assembly comprising:

a plurality of stacked laminations of magnetic material extending along a stacking axis, said laminations each having a certain thickness in a direction along the stacking axis, a solid core lamination member of magnetic material having opposing ends, said core lamination member being disposed centrally with respect to said plurality of stacked laminations such that each end of said core lamination member contacts one of the laminations of said plurality of laminations, said core lamination member having a thickness in a direction along said stacking axis greater than the thickness of each lamination, said core lamination member having an aperture therethrough disposed perpendicular to said stacking axis, and a bushing press-fitted in said aperture.

2. The core assembly according to claim 1, wherein each of said laminations and said core lamination member is of E-shape.

3. The core assembly according to claim 1, wherein said core lamination member is composed of silicon iron.

4. The core assembly according to claim 1, wherein ends of said core assembly which are parallel to said stacking axis are machined to be parallel with respect to each other.

5. The core assembly according to claim 1, further including at least one pin member extending from said solid core lamination member in a direction generally perpendicular to said stacking axis.

* * * * *